US011950700B2

(12) United States Patent
Chen et al.

(10) Patent No.: US 11,950,700 B2
(45) Date of Patent: Apr. 9, 2024

(54) SOFA BACKREST CONNECTION STRUCTURE AND SOFA ASSEMBLY

(71) Applicant: Remacro Technology Co., Ltd., Jiangsu (CN)

(72) Inventors: Weiming Chen, Jiangsu (CN); Xiaohong Li, Jiangsu (CN)

(73) Assignee: Remacro Technology Co., Ltd., Suzhou (CN)

( * ) Notice: Subject to any disclaimer, the term of this patent is extended or adjusted under 35 U.S.C. 154(b) by 563 days.

(21) Appl. No.: 17/261,882

(22) PCT Filed: Oct. 20, 2020

(86) PCT No.: PCT/CN2020/122033
§ 371 (c)(1),
(2) Date: Jan. 21, 2021

(87) PCT Pub. No.: WO2021/184748
PCT Pub. Date: Sep. 23, 2021

(65) Prior Publication Data

US 2022/0110453 A1 Apr. 14, 2022

(30) Foreign Application Priority Data

Mar. 19, 2020 (CN) ..... 202020350379.X

(51) Int. Cl.
*A47C 13/00* (2006.01)
*A47C 4/02* (2006.01)
(Continued)

(52) U.S. Cl.
CPC ..... *A47C 17/17* (2013.01); *A47C 4/02* (2013.01); *A47C 7/42* (2013.01); *A47C 13/005* (2013.01); *A47C 17/86* (2013.01)

(58) Field of Classification Search
CPC ..... A47C 13/005; A47C 4/02
See application file for complete search history.

(56) References Cited

U.S. PATENT DOCUMENTS 4,395,071 A * 7/1983 Laird ..... A47C 31/02 297/440.22
4,890,888 A * 1/1990 Kostin ..... B60N 2/68 297/440.21
(Continued)

FOREIGN PATENT DOCUMENTS

CA 2402583 A1 * 3/2003
CN 201171500 Y * 12/2008 ..... A47C 13/005
(Continued)

*Primary Examiner* — Timothy J Brindley

(57) ABSTRACT

The disclosure discloses a sofa backrest connection structure, including a first member and a second member, the first member includes a first base plate, two guide rails symmetrically arranged on the first base plate, and a limiting part arranged on the first base plate, and the limiting part is provided with a clamping protrusion; the second member includes a second base plate and a first horizontal plate connected to the second base plate, the second base plate includes an insertion part, and the insertion part is provided with a clamping hole matched with the clamping protrusion; after the insertion part is slidably inserted into and fitted with the two guide rails, the clamping protrusion is clamped in the clamping hole; and the first horizontal plate is used for being connected with a sofa seat frame, and the first base plate is used for being connected with a sofa backrest.

14 Claims, 3 Drawing Sheets

(51) Int. Cl.

| | |
|---|---|
| ***A47C 7/42*** | (2006.01) |
| ***A47C 17/17*** | (2006.01) |
| ***A47C 17/86*** | (2006.01) |

(56) References Cited

U.S. PATENT DOCUMENTS

| | | | | | |
|---|---|---|---|---|---|
| 5,000,512 | A * | 3/1991 | Laird | A47C 4/028 | 297/440.22 |
| 5,135,284 | A * | 8/1992 | Crum | A47C 7/42 | 297/440.15 |
| 5,518,298 | A * | 5/1996 | LaPointe | A47C 13/005 | 297/440.16 |
| 6,557,942 | B1 * | 5/2003 | Shieh | A47C 4/028 | 297/440.15 |
| 6,752,464 | B1 * | 6/2004 | Tseng | A47C 7/42 | 297/440.16 |
| 7,744,162 | B2 * | 6/2010 | Griggs, Jr. | A47C 4/028 | 297/440.16 |
| 11,067,111 | B2 * | 7/2021 | Selle | F16B 12/26 | |
| 11,202,507 | B1 * | 12/2021 | Yi | A47C 4/028 | |
| 11,464,339 | B2 * | 10/2022 | Milberg | A47C 13/005 | |
| 2002/0017814 | A1 * | 2/2002 | Niederman | A47C 4/028 | 297/440.16 |
| 2003/0011231 | A1 * | 1/2003 | Guillot | A47C 4/02 | 297/440.1 |
| 2004/0095000 | A1 * | 5/2004 | Durling | A47C 13/005 | 297/188.2 |
| 2021/0267377 | A1 * | 9/2021 | Vang | A47C 4/028 | |
| 2021/0368992 | A1 * | 12/2021 | Erdman | A47C 15/002 | |

FOREIGN PATENT DOCUMENTS

| | | | | | |
|---|---|---|---|---|---|
| CN | 204378597 | U | | 6/2015 | |
| CN | 204878183 | U | | 12/2015 | |
| CN | 205117909 | U | | 3/2016 | |
| CN | 110074589 | A | | 8/2019 | |
| DE | 4428794 | A1 | * | 2/1996 | A47C 13/005 |
| DE | 102020114675 | A1 | * | 3/2021 | A47C 13/005 |
| GB | 2478823 | A | * | 9/2011 | A47C 4/02 |
| JP | 2002045255 | A | * | 2/2002 | A47C 4/02 |

* cited by examiner

SOFA BACKREST CONNECTION STRUCTURE AND SOFA ASSEMBLY

FIELD OF THE INVENTION

The disclosure relates to the technical field of furniture, in particular to a sofa backrest connection structure and a sofa assembly.

BACKGROUND OF THE INVENTION

At present, a sofa backrest and a sofa main body on the market are usually fixedly connected through fasteners such as bolts or screws to be assembled into a sofa assembly structure. However, this fixed connection method is not conducive to the assembly and disassembly of the sofa backrest, which causes trouble in the transportation process, and the sofa backrest is difficult to replace and repair, resulting in material waste.

SUMMARY OF INVENTION

In order to overcome at least one of the above-mentioned defects in the prior art, the disclosure provides a sofa backrest connection structure and a sofa assembly.

The technical solutions adopted by the disclosure to solve the problems are as follows:

- a first aspect of the disclosure provides a sofa backrest connection structure which includes a first member and a second member, the first member includes a first base plate, two guide rails symmetrically arranged on the first base plate, and a limiting part which is arranged on the first base plate and located on the two guide rails, and the limiting part is provided with a clamping protrusion;
- the second member includes a second base plate and a first horizontal plate connected to the second base plate, the second base plate includes an insertion part, and the insertion part is provided with a clamping hole matched with the clamping protrusion;
- after the insertion part is slidably inserted into and fitted with the two guide rails, the clamping protrusion is clamped in the clamping hole; and
- the first horizontal plate is used for being connected with a sofa seat frame, and the first base plate is used for being connected with a sofa backrest.

Therefore, after the insertion part is slidably inserted into and fitted with the two guide rails, the clamping protrusion slides in and is clamped in the clamping hole, so that the first member and the second member are firmly connected through insertion. Through external force acting on the clamping protrusion, the clamping protrusion is slid out from the clamping hole, and then the first member and the second member can be separated. Through the sofa backrest connection structure of the disclosure, assembly and disassembly of the sofa backrest are simpler and more convenient, and then the efficiency of assembly and disassembly of the sofa assembly is improved.

Further, the first base plate is of the shape of a long strip plate, and the guide rails are of first bent structures formed by bending side edges of the first base plate toward one surface of the first base plate; the limiting part includes a second bent structure formed by bending the top edge of the first base plate toward one surface of the first base plate; and the first bent structures and the second bent structure are bent toward the same surface of the first base plate; and

- the clamping protrusion is connected to the second bent structure.

Further, an unlocking poke plate is further arranged on the limiting part, and the unlocking poke plate is connected to the clamping protrusion.

Thus, by external force acting on the unlocking poke plate, the clamping protrusion is slid out from the clamping hole, and then the first member and the second member are separated.

Further, the distance between the two guide rails gradually decreases along the axial direction of the first base plate.

Further, the width of the insertion part gradually decreases along the axial direction of the second base plate.

Thus the width of the insertion part is gradually reduced along the axial direction of the second base plate, so that the insertion part is just clamped into the two guide rails.

Further, the second base plate and the first horizontal plate are integrally bent and formed.

Therefore, the supporting strength of the integrally bent second member is higher, and machining is convenient.

Further, the second member is L-shaped.

Further, the clamping hole is a through hole.

In addition, a second aspect of the disclosure further provides a sofa assembly which includes the sofa backrest connection structures provided in the first aspect, a sofa seat frame and a sofa backrest, wherein:

- the sofa seat frame includes two symmetrically arranged cross beams and two longitudinal beams connected with the two cross beams; and
- first horizontal plates are connected with the upper surfaces of the longitudinal beams, and first base plates are connected with the sofa backrest.

In summary, according to the sofa backrest connection structure and the sofa assembly provided by the disclosure, by adopting the connection structure, the sofa backrest and a sofa main body can be firmly connected, and assembly and disassembly of the sofa backrest are more convenient, so that the assembly and disassembly efficiency of the sofa assembly is improved.

Figure 1:
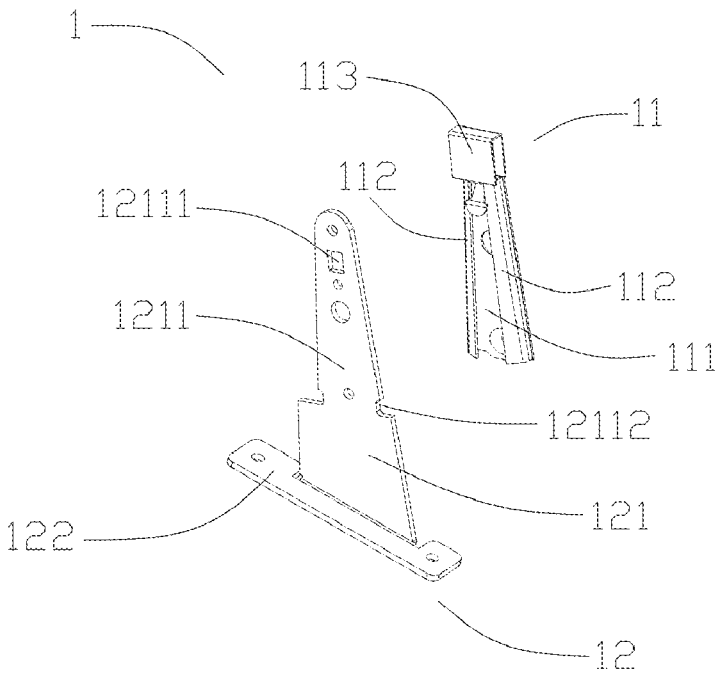
FIG. 1 is a schematic structural diagram of a sofa backrest connection structure according to Embodiment 1 of the disclosure.

Wherein, the reference numerals represent:

1, sofa backrest connection structure; 11, first member; 111, first base plate; 112, guide rails; 113, limiting part; 1131, second bent structure; 1132, clamping protrusion; 1133, unlocking poke plate; 12, second member; 121, second base plate; 1211, insertion part; 12111, clamping hole; 12112, limiting holes; 122, first horizontal plate; 2, sofa seat frame; 21, cross beams; 22, longitudinal beams; and 3, sofa backrest.

DETAILED DESCRIPTION OF THE ILLUSTRATED EMBODIMENTS

For a better understanding and implementation, the technical solutions in the embodiments of the disclosure will be described clearly and completely in conjunction with the accompanying drawings in the embodiments of the disclosure.

Unless otherwise defined, all technical and scientific terms used herein have the same meaning as commonly understood by those skilled in the technical field of the disclosure. The terms used in the description of the disclosure herein are only for the purpose of describing specific embodiments, and are not intended to limit the disclosure.

Embodiment 1

Figure 2:
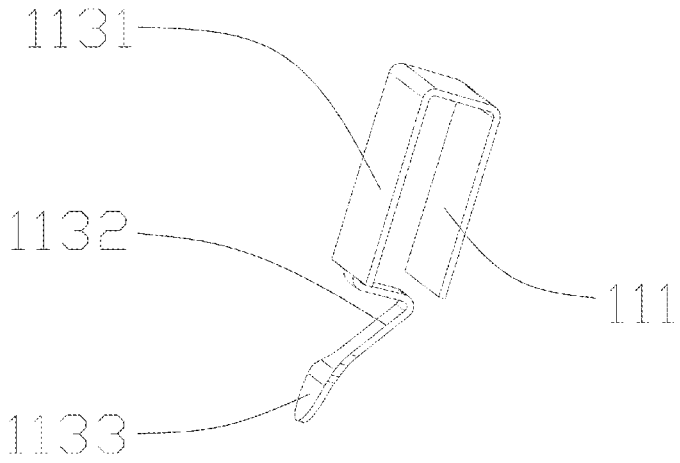
FIG. 2 is a schematic structural diagram of a limiting part in FIG. 1.

Referring to FIGS. 1-2, the disclosure discloses a sofa backrest connection structure 1 which includes a first member 11 and a second member 12, the first member 11 includes a first base plate 111, two guide rails 112 symmetrically arranged on the first base plate 111, and a limiting part 113 which is arranged on the first base plate 111 and located on the two guide rails 112; the limiting part 113 is provided with a clamping protrusion 1132; the second member 12 includes a second base plate 121 and a first horizontal plate 122 connected with the second base plate 121, the second base plate 121 includes an insertion part 1211, and the insertion part 1211 is provided with a clamping hole 12111 matched with the clamping protrusion 1132; and after the insertion part 1211 is slidably inserted into and fitted with the two guide rails 112, the clamping protrusion 1132 is clamped in the clamping hole 12111.

Wherein, the first horizontal plate 122 is used for being connected with a sofa seat frame 2, and the first base plate 111 is used for being connected with a sofa backrest 3.

Specifically, the first base plate 111 is of the shape of a long strip plate, and the guide rails 112 are of first bent structures formed by bending side edges of the first base plate 111 toward one surface of the first base plate 111; the limiting part 113 includes a second bent structure 1131 formed by bending the top edge of the first base plate 111 toward one surface of the first base plate 111; and the first bent structures and the second bent structure 1131 are bent toward the same surface of the first base plate 111. The clamping protrusion 1132 is connected to the second bent structure 1131.

In this embodiment, the first bent structures and the second bent structure 1131 are bent twice and are L-shaped; indeed, the first bent structures and the second bent structure 1131 may also be of other shapes in other embodiments; meanwhile, the first bent structures and the second bent structure 1131 may not be limited to integral bent structures, and may also be fixed to the first base plate 111 by welding. The clamping protrusion 1132 is provided with a vertical surface and an inclined surface, the clamping protrusion 1132 can slide into the clamping hole 12111 conveniently through the inclined surface, and the vertical surface may ensure that the clamping protrusion 1132 cannot be separated from the clamping hole 12111 easily. The clamping hole 12111 is a through hole.

In addition, referring to FIG. 2, an unlocking poke plate 1133 is further arranged on the limiting part 113, and the unlocking poke plate 1133 is connected to the tail end of the clamping protrusion 1132. In this embodiment, the unlocking poke plate 1133 is an inclined block and is inclined in a direction away from the first base plate 111 so that a user can conveniently push the unlocking poke plate to unlock.

Thus, by external force acting on the unlocking poke plate 1133, the clamping protrusion 1132 is slid out from the clamping hole 12111, and the first member 11 and the second member 12 can be separated.

Referring to FIGS. 1-2 again, the distance between the two guide rails 112 is gradually reduced along the axial direction of the first base plate 111, therefore the guide rails are roughly of the shape of a trapezoid. In this embodiment, the second base plate 121 is a substantially triangular straight plate, and the insertion part 1211 is the upper part of the second base plate 121 and is also substantially triangular, so that the insertion part 1211 is just clamped in the two guide rails 112. In addition, two limiting holes 12112 are formed in the two sides of the tail end of the insertion part 1211. When the insertion part 1211 is inserted into the two guide rails 112, the two guide rails 112 can abut against the two limiting holes 12112, then the insertion part and the guide rails are immovably fitted, and therefore the assembly stability of the sofa backrest 3 is improved.

In this embodiment, the second base plate 121 and the first horizontal plate 122 are integrally bent and formed, and are L-shaped. Therefore, the supporting strength of the second member 12 which is integrally bent and formed is higher, and machining is convenient. Indeed, the second base plate 121 and the first horizontal plate 122 may also be fixed by welding in other embodiments.

Embodiment 2

Figure 3:
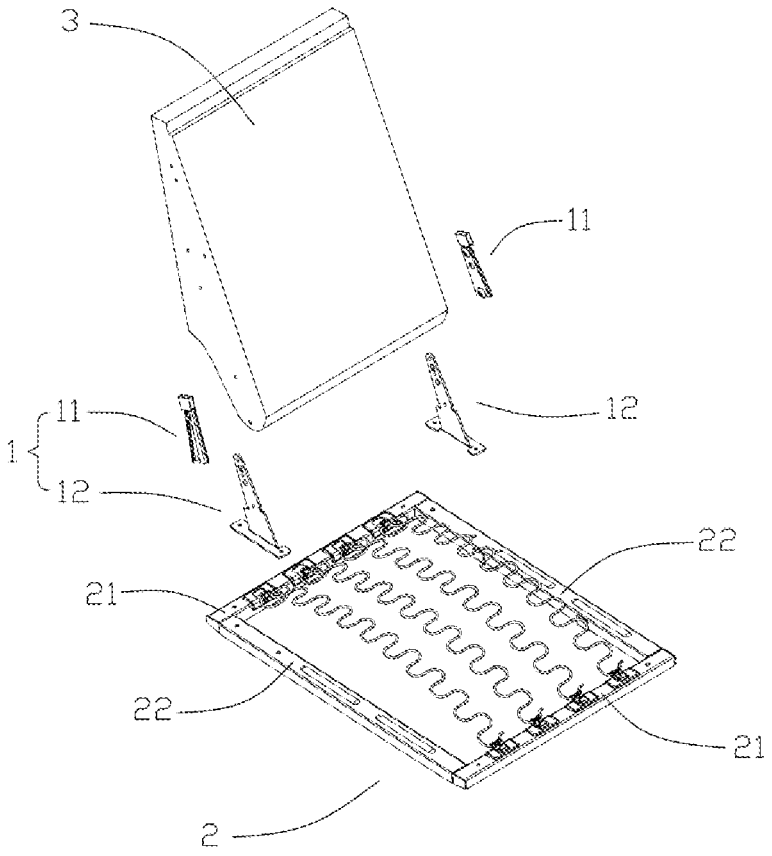
FIG. 3 is an exploded schematic diagram of a sofa assembly in Embodiment 2 of the disclosure.
Figure 4:
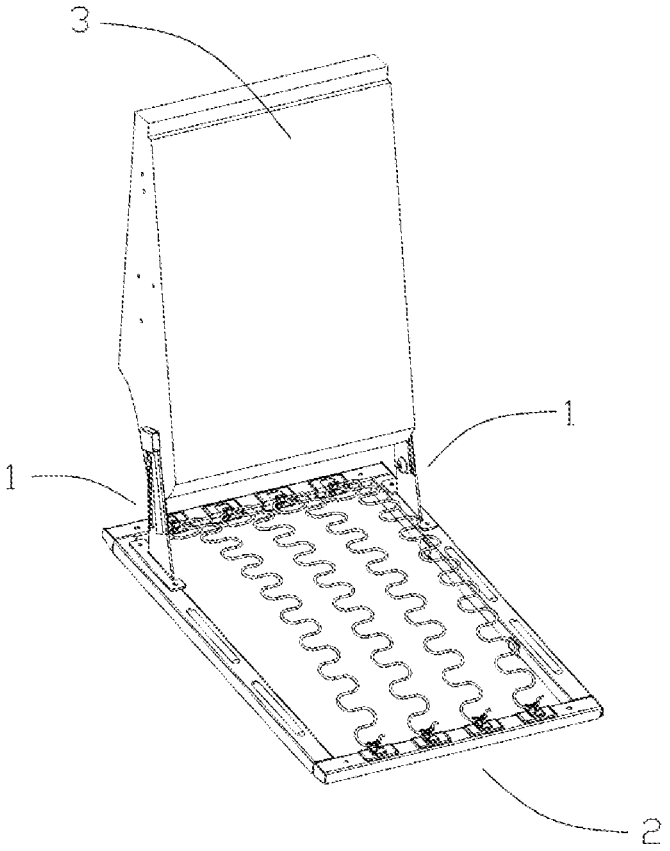
FIG. 4 is a schematic structural diagram of a sofa assembly in Embodiment 2 of the disclosure.

Referring to FIGS. 3-4, the disclosure further provides a sofa assembly which includes sofa backrest connection structures 1 in the Embodiment 1, a sofa seat frame 2 and a sofa backrest 3. The sofa seat frame 2 includes two symmetrically arranged cross beams 21 and two longitudinal beams 22 connected with the two cross beams 21.

In this embodiment, first horizontal plates 122 are connected to the upper surfaces of the longitudinal beams 22, and first base plates 111 are connected to the sofa backrest 3. Specifically, the first horizontal plates 122 and the longitudinal beams 22 are fixed by bolt connection, and the first base plates 111 and the sofa backrest 3 are also fixed by bolt connection.

In summary, through the sofa backrest connection structure 1 and the sofa assembly provided by the disclosure, the sofa backrest 3 and a sofa main body can be firmly connected, and the sofa backrest 3 is assembled and disassembled more conveniently, so that the assembly and disassembly efficiency of the sofa assembly is improved.

The technical means disclosed in the solutions of the disclosure are not limited to the technical means disclosed in the above-mentioned embodiments, but also include technical solutions composed of any combination of the above technical features. It should be noted that those of ordinary skill in the art can make several improvements and modifications without departing from the principle of the disclosure, and these improvements and modifications are also deemed to be within the protection scope of the disclosure.

The invention claimed is:

1. A sofa backrest connection structure, characterized by comprising a first member (11) and a second member (12), wherein the first member (11) comprises a first base plate (111), two guide rails (112) symmetrically arranged on the first base plate (111), and a limiting part (113) which is arranged on the first base plate (111) and located on the two guide rails (112), and the limiting part (113) is provided with a clamping protrusion (1132);

the second member (12) comprises a second base plate (121) and a first horizontal plate (122) connected to the second base plate (121), the second base plate (121) comprises an insertion part (1211), and the insertion part (1211) is provided with a clamping hole (12111) matched with the clamping protrusion (1132);

after the insertion part (1211) is slidably inserted into and fitted with the two guide rails (112), the clamping protrusion (1132) is clamped in the clamping hole (12111); and the first horizontal plate (122) is used for being connected with a sofa seat frame (2), and the first base plate (111) is used for being connected with a sofa backrest (3);

wherein the second base plate (121) and the first horizontal plate (122) are integrally bent and formed.

2. The connection structure according to claim 1, characterized in that the first base plate (111) is of a shape of a long strip plate, and the guide rails (112) are of first bent structures formed by bending side edges of the first base plate (111) toward one surface of the first base plate (111); the limiting part (113) includes a second bent structure (1131) formed by bending a top edge of the first base plate (111) toward one surface of the first base plate (111); and the first bent structures and the second bent structure (1131) are bent toward a same surface of the first base plate (111); and the clamping protrusion (1132) is connected to the second bent structure (1131).

3. The connection structure according to claim 2, characterized in that an unlocking poke plate (1133) is further arranged on the limiting part (113), and the unlocking poke plate (1133) is connected to the clamping protrusion (1132).

4. The connection structure according to claim 2, characterized in that a distance between the two guide rails (112) gradually decreases along an axial direction of the first base plate (111).

5. The connection structure according to claim 4, characterized in that a width of the insertion part (1211) gradually decreases along the axial direction of the second base plate (121).

6. The connection structure according to claim 1, characterized in that the second member (12) is L-shaped.

7. The connection structure according to claim 1, characterized in that the clamping hole (12111) is a through hole.

8. A sofa assembly, characterized by comprising the sofa backrest connection structures (1) according to claim 1, a sofa seat frame (2) and a sofa backrest (3), wherein:

the sofa seat frame (2) comprises two symmetrically arranged cross beams (21) and two longitudinal beams (22) connected with the two cross beams (21); and first horizontal plates (122) are connected with upper surfaces of the longitudinal beams (22), and first base plates (111) are connected with the sofa backrest (3).

9. A sofa assembly, characterized by comprising the sofa backrest connection structures (1) according to claim 2, a sofa seat frame (2) and a sofa backrest (3), wherein:

the sofa seat frame (2) comprises two symmetrically arranged cross beams (21) and two longitudinal beams (22) connected with the two cross beams (21); and first horizontal plates (122) are connected with upper surfaces of the longitudinal beams (22), and first base plates (111) are connected with the sofa backrest (3).

10. A sofa assembly, characterized by comprising the sofa backrest connection structures (1) according to claim 3, a sofa seat frame (2) and a sofa backrest (3), wherein:

the sofa seat frame (2) comprises two symmetrically arranged cross beams (21) and two longitudinal beams (22) connected with the two cross beams (21); and first horizontal plates (122) are connected with upper surfaces of the longitudinal beams (22), and first base plates (111) are connected with the sofa backrest (3).

11. A sofa assembly, characterized by comprising the sofa backrest connection structures (1) according to claim 4, a sofa seat frame (2) and a sofa backrest (3), wherein:

the sofa seat frame (2) comprises two symmetrically arranged cross beams (21) and two longitudinal beams (22) connected with the two cross beams (21); and first horizontal plates (122) are connected with upper surfaces of the longitudinal beams (22), and first base plates (111) are connected with the sofa backrest (3).

12. A sofa assembly, characterized by comprising the sofa backrest connection structures (1) according to claim 5, a sofa seat frame (2) and a sofa backrest (3), wherein:

the sofa seat frame (2) comprises two symmetrically arranged cross beams (21) and two longitudinal beams (22) connected with the two cross beams (21); and first horizontal plates (122) are connected with upper surfaces of the longitudinal beams (22), and first base plates (111) are connected with the sofa backrest (3).

13. A sofa assembly, characterized by comprising the sofa backrest connection structures (1) according to claim 6, a sofa seat frame (2) and a sofa backrest (3), wherein:

the sofa seat frame (2) comprises two symmetrically arranged cross beams (21) and two longitudinal beams (22) connected with the two cross beams (21); and first horizontal plates (122) are connected with upper surfaces of the longitudinal beams (22), and first base plates (111) are connected with the sofa backrest (3).

14. A sofa assembly, characterized by comprising the sofa backrest connection structures (1) according to claim 7, a sofa seat frame (2) and a sofa backrest (3), wherein:

the sofa seat frame (2) comprises two symmetrically arranged cross beams (21) and two longitudinal beams (22) connected with the two cross beams (21); and first horizontal plates (122) are connected with upper surfaces of the longitudinal beams (22), and first base plates (111) are connected with the sofa backrest (3).

* * * * *